US007081284B2

(12) United States Patent
Hiroishi

(10) Patent No.: US 7,081,284 B2
(45) Date of Patent: Jul. 25, 2006

(54) THERMAL TRANSFER RECORDING MEDIUM, METHOD OF RECORDING SAME, RECORDED MEDIUM AND RECORDED LABEL

(75) Inventor: Katsunori Hiroishi, Hadano (JP)

(73) Assignee: Ricoh Company, Ltd., Tokyo (JP)

( * ) Notice: Subject to any disclaimer, the term of this patent is extended or adjusted under 35 U.S.C. 154(b) by 322 days.

(21) Appl. No.: 10/779,776

(22) Filed: Feb. 18, 2004

(65) Prior Publication Data

US 2004/0162219 A1 Aug. 19, 2004

(30) Foreign Application Priority Data

Feb. 18, 2003 (JP) ..... 2003-039790
Dec. 18, 2003 (JP) ..... 2003-421515

(51) Int. Cl.
*B41M 5/40* (2006.01)

(52) U.S. Cl. ..... 428/32.6; 428/32.8; 428/32.81; 428/32.82; 428/32.85

(58) Field of Classification Search ..... 428/32.6, 428/32.8, 32.81, 32.82, 32.85
See application file for complete search history.

(56) References Cited

U.S. PATENT DOCUMENTS

| | | | |
|---|---|---|---|
| 5,219,610 | A | 6/1993 | Koshizuka et al. |
| 5,482,911 | A | 1/1996 | Hiroishi et al. |
| 6,787,203 | B1 | 9/2004 | Hiroishi et al. |

FOREIGN PATENT DOCUMENTS

| | | |
|---|---|---|
| JP | 63-130385 | 6/1988 |
| JP | 63-309493 | 12/1988 |
| JP | 05-077562 | 3/1993 |
| JP | 07-005810 | 1/1995 |
| JP | 08-230341 | 9/1996 |
| JP | 2001-199171 | 7/2001 |

OTHER PUBLICATIONS

European Search Report, Jul. 19, 2004.

*Primary Examiner*—Bruce H. Hess
(74) *Attorney, Agent, or Firm*—Oblon, Spivak, McClelland, Maier & Neustadt, P.C.

(57) ABSTRACT

A thermal transfer recording medium is provided wherein the thermal transfer recording medium has a substrate; a separation layer on the substrate, wherein the separation layer contains a resin and a wax; and an ink layer on the separation layer, wherein the ink layer contains a colorant and a metal salt of an ethylene-methacrylic acid copolymer, and, optionally, one or more diols or diol derivatives containing an acetylene group, a thermal transfer recording method using the medium, and a recorded medium and recorded label prepared therefrom.

43 Claims, 1 Drawing Sheet

THERMAL TRANSFER RECORDING MEDIUM, METHOD OF RECORDING SAME, RECORDED MEDIUM AND RECORDED LABEL

FIELD OF INVENTION

The present invention relates to a thermal transfer recording medium, a receiving medium and a thermal transfer recording method therefor, and more particularly to a thermal transfer recording medium and a receiving medium which can produce images having good resistance to organic solvent such as xylene, acetone and toluene, and to a thermal transfer recording method therefor.

DISCUSSION OF THE BACKGROUND

Conventionally, image formation by use of a thermal transfer recording medium is known, wherein the thermal transfer recording medium is heated with a thermal head, causing imagewise transfer of the ink to the receiving medium to form the image. This method is typically used the preparation of labels, such as name plates.

A thermal transfer recording medium is required to have satisfactory heat sensitivity. Furthermore, when the recording medium is used in an environment containing an organic solvent, such as xylene, acetone or toluene, it is necessary that the image transferred to the label be stable and not eliminated by the presence of the organic solvent.

It has been proposed to add a resin of a specific type to the ink layer and receiving layer in order to obtain superior solvent resistance of the transferred image. For example, an ink layer and receiving layer containing a polyolefin is shown in Japanese Laid Open Patent Publication No H07-5810. The addition of nylon to the ink layer and the receiving layer is shown in Japanese Laid-Open Patent Publication No. H04-347688 and Japanese Laid-Open Patent Publication No. 2001-199171. In Japanese Laid-Open Patent Publication No. H08-230341, an impression thermal transfer recording medium is disclosed which uses an ink layer and receiving layer containing a polyester as the main component.

However, the solvent resistance of recorded images in these is not sufficient.

Another proposed solution provides that the ink layer comprises a metal salt of ethylene-methacrylic acid copolymer. Methacrylic acid has a structure that forms a bridge between the molecule chains by the cation of the metal. When it is heated, the ion bridge becomes poor, and becomes flexible and an ionic bond becomes strong at the time of non-heating, and becomes stronger. Therefore the softening point of the metal salt of ethylene-methacrylic acid copolymer is low, in the temperature range of from 55° C. to 70° C. However, it has excellent solvent resistance.

The use of a metal salt of ethylene-methacrylic acid copolymer in a thermal transfer recording medium has been previously proposed. (Japanese Laid-open Patent Publication No.S63-130385, Japanese Laid-open Patent Publication No.S63-309493, Japanese Laid-open Patent Publication No. H05-77562 and Japanese Laid-open Patent Publication No. H08-230341.) However, the solvent resistance of the recorded image is not sufficient in such cases, particularly with respect to solvents such as xylene, acetone and toluene.

SUMMARY OF THE INVENTION

Accordingly, one object of the present invention is to provide a thermal transfer recording medium having improved chemical solvent resistance, particularly with respect to solvents containing xylene or acetone or toluene.

Another object of this invention is to provide a thermal transfer recording method, a receiving medium, a recorded medium and a recorded label having improved chemical solvent resistance, particularly with respect to solvents containing xylene or acetone or toluene.

These and other objects of the present invention have been satisfied, either individually or in combination, by the discovery of a thermal transfer recording medium, comprising an ink layer having therein a metal salt comprising at least one metal salt component selected from the group consisting of a sodium salt of ethylene-methacrylic acid copolymer and a potassium salt of ethylene-methacrylic acid copolymer, wherein the metal salt has specific properties, and its use in a thermal transfer recording method, its use in preparing a recorded medium or a recorded label, and a receiving medium containing the metal salt.

BRIEF DESCRIPTION OF THE FIGURES

Various other objects, features and attendant advantages of the present invention will be more fully appreciated as the same becomes better understood from the following detailed description when considered in connection with the accompanying drawings in which like reference characters designate like or corresponding parts throughout the several views and wherein:

FIGS. 1(*a*) and 1(*b*) show the thermal transfer recording medium and thermal transfer recording method of the present invention, wherein:

FIG. 1(*a*) shows the condition before transcribing ink into the receiving medium from the thermal transfer recording medium.

FIG. 1(*b*) shows the condition after ink is transcribed into the receiving medium from the thermal transfer recording medium.

DETAILED DESCRIPTION OF THE INVENTION

Figure 1A:
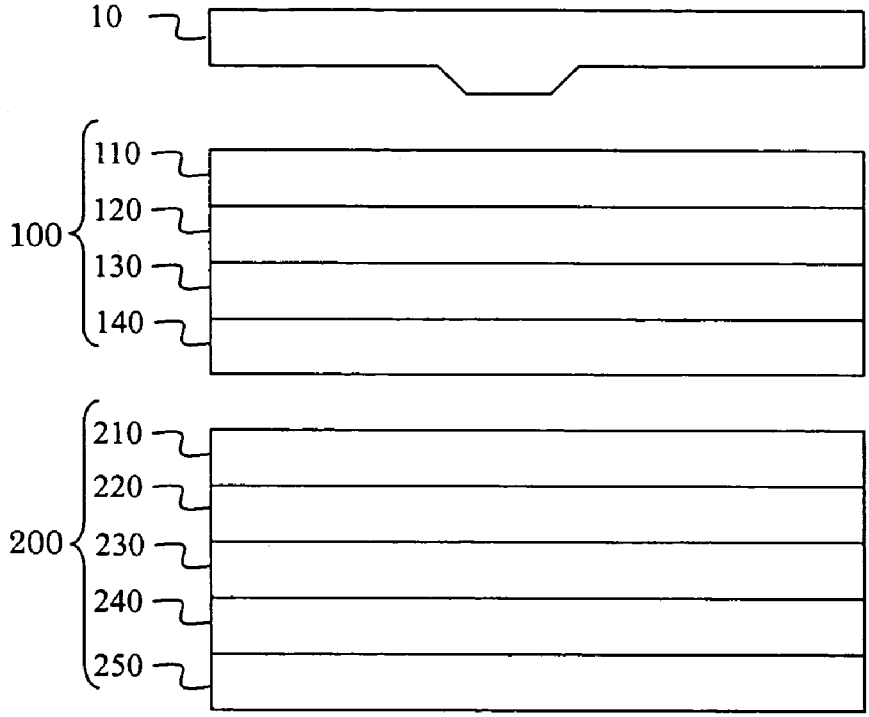

The present invention relates to a thermal transfer recording medium comprising a substrate, a separation layer on said substrate, wherein the separation layer comprises a resin and a wax; and an ink layer on said separation layer, wherein the ink layer comprises a colorant and a metal salt of an ethylene-methacrylic acid copolymer, said metal salt comprising at least one metal salt component selected from the group consisting of a sodium salt of ethylene-methacrylic acid copolymer and a potassium salt of ethylene-methacrylic acid copolymer, and wherein the metal salt of the ethylene-methacrylic acid copolymer has a tensile strength (ASTM D 1708) of from 240 kg/cm$^2$ to 300 kg/cm$^2$ and a percentage elongation at break (ASTM D 1708) of from 410% to 560%.

In one preferred embodiment of the present invention, the wax comprises a polyethylene wax having a melting point (DSC method) of 120° C. or above, or with softening point of 120° C. or above. In another more preferred embodiment, the polyethylene wax has a particle diameter of 2 μm or less.

In another preferred embodiment, the resin of the separation layer comprises a methyl methacrylate-butadiene copolymer, more preferably a methyl methacrylate-butadiene copolymer having a glass transition temperature of 0° C. or less.

The present invention further relates to a thermal transfer image recording method comprising:

contacting a thermal transfer recording medium and a receiving medium with one another, wherein the receiving medium comprises a substrate having a receiving layer thereon, wherein the receiving layer comprises a resin and an inorganic pigment, heating an ink layer of the thermal transfer recording medium with a thermal head while the ink layer contacts the receiving layer to form an receiving layer on the substrate.

In a preferred embodiment of the above method, the pigment comprises a calcium ion and/or a magnesium ion, and the resin in the receiving layer comprises a salt of an ethylene-methacrylic acid copolymer. More preferably, the salt of the ethylene-methacrylic acid copolymer is crosslinked using an epoxy compound as a crosslinking agent.

In another preferred embodiment of the above method, the inorganic pigment in the receiving layer has a particle diameter of from 2.5 μm to 4.0 μm. Preferably, the inorganic pigment is included in the receiving layer in an amount of from 50% to 90% by weight based on total weight thereof.

In an additional preferred embodiment of the above method, the receiving layer further comprises a sodium salt of carboxylate modified polyvinyl alcohol.

In a preferred embodiment of the present method, the metal salt of an ethylene-methacrylic acid copolymer comprises at least one metal salt component selected from the group consisting of a sodium salt of ethylene-methacrylic acid copolymer and a potassium salt of ethylene-methacrylic acid copolymer, and having a tensile strength (ASTM D 1708) of from 240 kg/cm$^2$ to 300 kg/cm$^2$ and having a percentage elongation at break (ASTM D 1708) of from 410% to 560%.

In a further embodiment of the above method, the surface of the receiving layer has a smoothness of from 500 sec to 1500 sec when measured by the method JIS P-8119, and/or an area density of from 4 g/m$^2$ to 8 g/m$^2$.

The method of the present invention can further comprise an under layer located between said substrate and said thermal transfer receiving layer.

Additionally, the method of the present invention can further comprise a lamination layer of synthetic paper in the thermal transfer recording medium, which comprises polypropylene and calcium carbonate. The thermal transfer recording medium used in the method can further comprise an adhesive layer provided on a backside of said substrate, an a side of said substrate that is opposite said thermal transfer receiving layer. Optionally, a releasable backing sheet can be provided on the adhesive layer.

The present invention further relates to a recorded medium or recorded label formed from the method of the present invention.

In an alternative embodiment of the present invention is provided a thermal transfer recording medium comprising:

a substrate an ink layer formed on said substrate; and said ink layer comprising;

a colorant, a metal salt of an ethylene-methacrylic acid copolymer, and one or more of a diol and diol derivatives, having an acetylene group.

In a preferred embodiment, the separation layer further comprises a resin and a wax, and more preferably even further comprises one or more of a diol and diol derivatives having an acetyl group.

In this embodiment of the present invention, the ink layer preferably has a thickness of from 0.6 μm to 1.0 μm; and the separation layer has a thickness of from 0.8 μm to 1.2 μm.

In this embodiment of the present invention recording medium, the resin preferably comprises a methyl methacrylate-butadiene copolymer, more preferably a methyl methacrylate-butadiene copolymer having a glass transition temperature of 0° C. or less.

Also in this embodiment, the wax preferably comprises a polyethylene wax, more preferably a polyethylene wax having a melting point (DSC method) of 120° C. or above, or with softening point of 120° C. or above, still more preferably having a particle diameter of 2 μm or less.

In a further embodiment of the present invention is provided a thermal transfer image recording method comprising:

contacting a thermal transfer recording medium and a receiving medium with one another, wherein the receiving medium comprises a substrate having a receiving layer thereon, the receiving layer comprising a resin and an inorganic pigment;

heating an ink layer of the thermal transfer recording medium with a thermal head while the ink layer contacts the receiving layer to form an receiving layer on the substrate.

In the above method of the present invention, the inorganic pigment preferably comprises a calcium ion and/or a magnesium ion, and the resin in the receiving layer preferably comprises a salt of an ethylene-methacrylic acid copolymer. More preferably, the salt of the ethylene-methacrylic acid copolymer is crosslinked using a epoxy compound as a crosslinking agent.

Preferably in the above method, the inorganic pigment in the receiving layer has a particle diameter of from 2.5 μm to 4.0 μm. Preferably, the inorganic pigment is included in the receiving layer in an amount of from 50% to 90% by weight based on total weight thereof.

In a preferred embodiment of the method, the receiving layer further comprises a sodium salt of a carboxylate modified polyvinyl alcohol. Further, it is preferred that the surface of the receiving layer has a smoothness of from 500 sec to 1500 sec when measured by the method JIS P-8119 and/or an area density of from 4 g/m$^2$ to 8 g/m$^2$.

In another preferred embodiment of the method, the thermal receiving medium further comprises a synthetic paper comprising polypropylene and calcium carbonate.

Preferably the thermal transfer recording medium used in the method further comprises an adhesive layer provided on a backside of the substrate, on a side of the substrate opposite to the thermal transfer receiving layer. Still further, the thermal transfer recording medium of the present method further comprises a releasable backing sheet provided on the adhesive layer.

Also within the present invention is a recorded medium and recorded label formed from the above noted method.

The present invention provides a thermal transfer recording medium, thermal transfer recording method, recorded medium and recorded label, which have excellent resistance to solvents such as xylene, acetone and toluene.

Figure 1B:
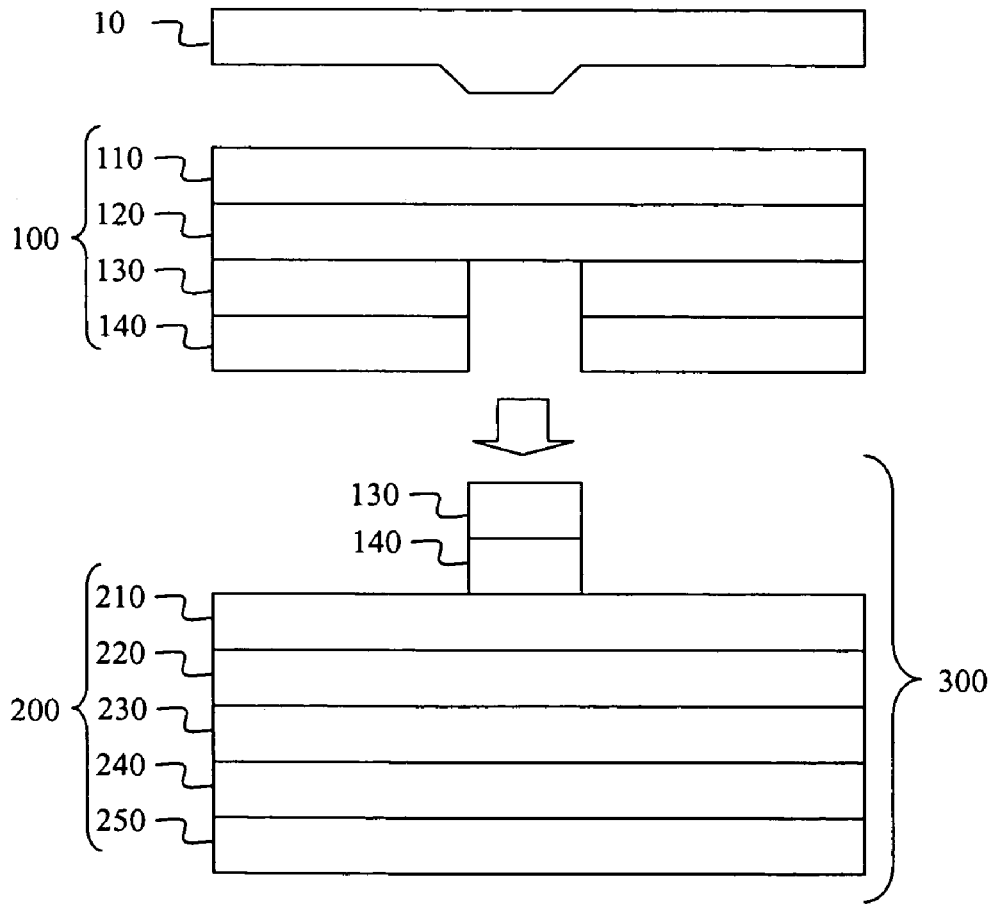

FIGS. 1(*a*) and (*b*) show an embodiment of the thermal transfer recording method of the present invention. Thermal transfer recording medium 100 is heated by the thermal head 10, and an image is transferred from thermal transfer recording medium 100 to the receiving medium 200.

For example FIG. 1(*a*) describes a thermal transfer recording medium 100 comprising protective layer 110, the substrate 120, the separation layer 130 and the ink layer 140 wherein the ink layer includes a colorant. The receiving medium 200 comprises an ink receiving layer 210 on or in which ink is received, under layer 220, substrate 230, adhesive layer 240 and releasable backing sheet 250.

In the thermal transfer recording method of the present invention, thermal transfer recording medium 100 is heated by application of a thermal-head 10. At least a part of separation layer 130 and ink layer 140 melts from substrate 120 of the thermal transfer recording medium 100. Then, substrate 120 of thermal transfer recording medium 100 releases the separation layer 130. Ink is thus transferred onto the ink receiving layer 210 of the receiving medium 200. The portion of separation layer 130 and ink layer 140 that melts from substrate 120 of thermal transfer recording medium 100 is transferred to the ink receiving layer 210 of receiving medium 200 to form an image. This becomes the recorded medium 300. After the image is transferred, the portion of separation layer 130, which transferred on the receiving medium 200, protects the portion of ink layer 140, which also transferred on the receiving medium 200. Recorded medium 300 has a strippable paper carrier through the adhesive layer 240 with the ink receiving layer 210 of substrate 230 of the receiving medium 200 on the opposite side. Then, a pasted releasable backing sheet 250 can be removed. Therefore, the adhesion of the adhesive layer 240 is used in an embodiment wherein after removal of the releasable backing wheet 250, the recorded medium can be pasted in the desired place as a label. Alternatively, the thermal transfer recording medium of the present invention can be used as a thermal transfer recording ribbon.

The thermal transfer recording medium of the present invention comprises:

a substrate a separation layer on the substrate, wherein the separation layer comprises a resin and a wax; and an ink layer on the separation layer, wherein the ink layer comprises a colorant and a metal salt of an ethylene-methacrylic acid copolymer, wherein the metal salt comprises at least one metal salt component selected from the group consisting of a sodium salt of ethylene-methacrylic acid copolymer and a potassium salt of ethylene-methacrylic acid copolymer, and having a tensile strength (ASTM D 1708) of from 240 kg/cm$^2$ to 300 kg/cm$^2$ and having a percentage elongation at break (ASTM D 1708) of from 410% to 560%.

(ASTM D 1708 is a standard by American Society for Testing and Materials, incorporated herein in its entirety).

In another embodiment of the present invention, the thermal transfer recording medium of the present invention comprises a substrate, and an ink layer on the substrate, wherein the ink layer comprises a colorant, a metal salt of an ethylene-methacrylic acid copolymer and one or more diols or diol derivatives, having an acetylene group.

In the present invention, the thermal transfer recording medium can further comprise a separation layer including a binder and a wax. In this embodiment, preferably the separation layer is on the substrate, and the ink layer is on the separation layer.

Generally, a metal salt of ethylene-methacrylic acid copolymer is very hard to dissolve in the typical solvents. Therefore, it must be melted with heat for use. However, the ink layer is formed on the releasing layer which contains a wax in an embodiment of the present invention. Upon heating, the wax softens and gets loose, causing the separation layer to mix with the ink layer and reducing the image quality.

Therefore, in the present invention, the metal salt of ethylene-methacrylic acid copolymer is preferably dispersible in water. Suitable metal salts of ethylene-methacrylic acid include, but are not limited to, Chemipearl S-650 and S-659 manufactured by Mitsui Chemistry, Inc.

The metal salt of ethylene-methacrylic acid copolymer may have one or more carboxylate groups (—COO—). In the salt of an ethylene-methacrylic acid copolymer which is used as a resin in the ink receiving layer, at least part of carboxylate groups (—COO$^-$) contain an ionic bond to each other through the cation of the metal such as sodium, potassium, calcium and zinc, and in the structural unit of methacrylic acid are ionically bonded to cross-link the molecular chains of the copolymer. A part of methacrylic acid has the structure that it constructs a bridge by the cation of the metal between the molecule chains with this metal salt of ethylene-methacrylic acid copolymer.

When this is heated, the ion bridge becomes poor, and becomes flexible. In non-heated times, the ionic bond becomes stronger. Therefore the softening point of metal salt of ethylene-methacrylic acid copolymer is preferably low, more preferably from 55° C. to 70° C. However, it has an excellent solvent resistance.

In order to improve the solvent resistance of the heat recording medium, the ink layer may also contain a metal salt of ethylene-methacrylic acid copolymer of this type. The metal salt of ethylene-methacrylic acid copolymer in the ink layer is preferably present in an amount of 50 wt % or more. When the metal salt of ethylene-methacrylic acid copolymer in the ink layer is present in an amount less than 50 wt %, the solvent resistance of the transferred image on the receiving medium is decreased.

To improve the solvent resistance against solvents such as acetone and toluene, the amount of methacrylic acid component in the ethylene-methacrylic acid copolymer in the ink layer is preferably in the range of from 17 wt % to 50 wt %.

Other resins can optionally be added to the ink layer of the thermal transfer recording medium of the present invention as desired. Suitable such other resins are preferably water-soluble polymers, including, but not limited to;

polyvinyl alcohol, and its derivatives such as;

partially saponified polyvinyl alcohol, fully saponified polyvinyl alcohol, carboxyl group, sodium salt of sulfonic acid group, acetoacetyl group or cation type group modified polyvinyl;

starch and its derivatives;

cellulose and its derivatives, such as methoxy cellulose, hydroxyethyl cellulose, carboxymethyl cellulose, methyl cellulose, ethyl cellulose, nitro cellulose, cellulose acetate;

polyacrylic acid, sodium polyacrylate, poly(vinylpyrrolidone), acrylamide-acryl ester copolymer, acrylamide-acryl ester-methacrylic acid terpolymer, alkaline salt of isobutylene-maleic anhydride copolymer, polyacrylamide, sodium alginate,
gelatin;
polyvinyl acetate,
polyurethane,
styrene-butadiene copolymer,
acrylic nitrile-butadiene copolymer,
styrene-butadiene-acrylic copolymer,
polyacrylic acid,
polyacrylic ester,
polymethacrylic acid ester,
vinyl chloride-vinyl acetate copolymer,
ethylene-vinyl acetate copolymer,
vinyl acetate-acrylic acid copolymer,
ethylene-vinyl acetate-acrylic acid copolymer,
urethane modified polyethylene,
styrene-acrylic ester copolymer,
ethylene-propylene copolymer,
ethylene-vinyl copolymer,
vinyl acetate-ethylene-vinyl chloride copolymer,
polyester,
polyamide,
isoprene rubber,
isobutylene-isoprene rubber,
polyvinyl butyral,
polyvinyl formal,
epoxy resin,
petroleum resin,
phenol resin,
styrene resin,
terpen resin,
cyclopentadiene polymer,
polyethylene,
polyvinyl chloride,
polyvinylidene chloride,
polypropylene,
polypropylene chloride,
polybutene,
rosin,
Emulsion or dispersion of a metal salt of a resin such as,
maleic acid resin
α-olefin-maleic anhydride copolymer,
propylene-butene copolymer, or
ethylene-acrylate copolymer.

One or more further additives can optionally be added to the ink layer of the thermal transfer recording medium of the present invention as desired, such as additives for improving the heat transfer and/or the image resolution. Suitable such additives are known in the art, and include, but are not limited to:
wax-like fatty acid amides,
lubricants,
synthetic waxes such as,
paraffin wax,
polyethylene wax,
natural waxes such as,
candelilla wax,
carnauba wax
lubricating preparations such as,
phosphonic acid esters and
resin particles such as
silicone resins,
tetrafluoroethylene resins,
fluoroalkyl ether resins.

As the coloring agent, for instance, any desired colorants can be used, including but not limited to, carbon black, organic pigments, inorganic pigments, and varieties of dyes known to those of ordinary skill in the art, in accordance with the desired color.

In another embodiment of the thermal image transfer recording medium of the present invention, the ink layer thereof comprises a metal salt of an ethylene-methacrylic copolymer, and one or more of diols having an acetylene group (carbon-carbon triple bond) and/or diol derivatives having an acetylene group.

Examples of diols having an acetylene group and diol derivatives having an acetylene group that can be used in combination with the metal salt of an ethylene-methacrylic copolymer in the ink layer of the present invention, include, but are not limited to, non-ionic surfactants having an acetylene group (acetylene glycol), such as 2,4,7,9-tetramethyl-5-decyn-4,7-diol and ethoxylated 2,4,7,9-tetramethyl-5-decyn-4,7-diol (a compound of 2,4,7,9-tetramethyl-5-decyn-4,7-diol in which at least one hydroxyl group of the two hydroxyl groups contained therein is replaced by an ethoxy group).

In the ink layer of such a thermal image transfer recording medium, the image transferred from the receiving medium exhibits excellent resistance to solvents such as xylene and toluene, by use of combination of a metal salt of an ethylene-methacrylic copolymer, and one or more diols having an acetylene group (carbon-carbon triple bond) and/or diol derivatives having an acetylene group.

In this embodiment, the amount of the metal salt of ethylene-methacrylic acid copolymer in the ink layer is preferably in the range of 50 wt % or more. When the metal salt of ethylene-methacrylic acid copolymer in the ink layer is present in an amount of less than 50 wt %, the transferred image on the receiving medium shows decreased solvent resistance.

The amount of the one or more diols or diol derivatives having an acetylene group, in the ink layer is preferably in the range of from 0.2 wt % to 2.0 wt %. When the amount of the diol or diol derivative in the ink layer is less than 0.2 wt %, the transferred image on the receiving medium shows decreased solvent resistance. When the amount of the diol or diol derivative is in a range of more than 2.0 wt %, the transferred image exhibits shedding of the ink and the uniformity of the ink layer decreases.

The thermal transfer recording medium of the present invention can further comprise a separation layer between the substrate and ink layer. Preferably, the main components of the separation layer are a resin and a wax. When thermal energy is applied from the thermal head, the separation layer provides for easier release of the ink from the substrate, and heat sensitivity is also improved. The separation layer is preferably located on the ink layer, the image transferred and the ink layer are more protected from the solvent.

To obtain a thermal transfer recording medium according to the present invention, a conventional resin can preferably be employed in the separation layer. Suitable examples of resin include, but are limited to:
ethylene-vinyl acetate copolymer,
metal salt of ethylene-methacrylic acid copolymer,
poly(vinyl acetal) such as
polyamide,
polyester,
polyurethane,
polyvinyl alcohol,
poly(vinyl formal),
poly(vinyl butyral),
cellulose derivatives such as
nitro cellulose, methyl cellulose,
ethyl cellulose,
acetic acid cellulose,
poly(vinyl chloride),
poly(vinylidene chloride),
isoprene rubber,
butadiene resins,
ethylene propylene rubber,
butyl rubber,
nitrile rubber,
polyvinyl acetate,
polyacrylic acid,
polyacrylic ester,
poly methacrylic acid ester,
urethane modified polyethylene,
polypropylene chloride,
epoxy resin,
ethylene-propylene copolymer,
propylene-butene copolymer,
ethylene-vinyl chloride copolymer,
vinyl acetate-ethylene-vinyl chloride copolymer,
styrene-butadiene copolymer,
acrylonitrile-butadiene copolymer,
methyl-methacrylate-butadiene copolymer,
styrene-butadiene-acrylic copolymer,
vinyl chromed-vinyl acetate copolymer,
vinyl acetate-acrylic copolymer,
ethylene-vinyl acetate-acrylic copolymer,
styrene-acrylic ester copolymer.

Preferably, the resin is a metal salt of a ethylene-vinyl acetate copolymer, or a metal salt of ethylene-methacrylic acid copolymer When the separation layer of the present invention comprises a methyl methacrylate butadiene copolymer, the received image on the receiving medium has a good resistance to solvents, such as ethanol, and moreover has good image sharpness. Suitable methyl methacrylate butadiene copolymers preferably have a glass transition temperature of 0° C. or less. When a methyl methacrylate butadiene copolymer having a glass transition temperature of 0° C. or less is used, the adhesiveness to substrate of the separation layer is satisfactory and moreover has good image sharpness. When a methyl methacrylate butadiene copolymer having a glass transition temperature of more than 0° C. is used, the adhesiveness to substrate of the separation layer is decreased and the medium has worse image sharpness.

It is preferable that the amount of methyl methacrylate butadiene copolymer be in a range of from 3 wt % to 50 wt %, more preferably in a range of from 3 wt % to the 50 wt %, most preferably in a range of from 5 wt % to 10 wt %. When methyl methacrylate butadiene copolymer is present in an amount of less than 3 wt %, the adhesiveness to substrate of separation layer is decreased. When methyl methacrylate butadiene copolymer is present in an amount of more than 50 wt %, the adhesiveness to substrate of separation layer is also decreased and transferrance of the ink to the receiving layer is blocked.

The separation layer of the thermal transfer recording medium preferably comprises a methyl methacrylate butadiene copolymer, and another resin if necessary, can be added. When the separation layer comprises methyl methacrylate butadiene copolymer and another resin, the methyl methacrylate butadiene copolymer is preferably in the range of from 50 wt % to 90 wt % in the total weight of resins.

The methyl methacrylate butadiene copolymer can be the copolymer synthesized from methyl methacrylate and butadiene, or optionally, can be a terpolymer comprising a uints obtained from a third monomer copolymerizable with methyl methacrylate and butadiene. Suitable terpolymers include but are not limited to, methyl methacrylate-butadiene-styrene copolymers. In such terpolymers, it is preferable that the amount of the third monomer element doesn't exceed the amount of methyl methacrylate.

As the wax that it is added to the separation layer in the present invention, one or more waxes can be used, including, but not limited to:
bees wax,
whale wax,
Japan wax,
rice wax,
carnauba wax,
candelilla wax,
montan wax,
paraffin wax,
polyethylene wax,
oxydized polyethylene wax,
acid modified polyethylene wax,
microcrystalline wax,
acid wax,
ozokerite,
ceresin,
ester wax,
margaric acid,
lauric acid,
myristic acid,
palmitic acid,
stearic acid,
freund acid,
abehenic acid,
lignoceric acid,
montan acid,
stearyl alcohol,
stearyl alcohol,
behenyl alcohol,
sorbitan,
stearic amide,
oleic amide.

More preferably, the wax is a polyethylene wax. Polyethylene wax is excellent in solvent resistance, has a high lubricity and is hard. Friction in the separation layer is decreased by using a polyethylene wax having high lubricity as the wax contained in the separation layer. Excellent protection of the ink layer transferred to the receiving medium against friction can also be provided by the wax. It is preferable to use a high density polyethylene wax having a softening point or melting point by DSC (differential scanning calorimetry) more than 120° C. The high hardness of such high density polyethylenes helps to protect the image transferred. It is also preferable that the particle diameter of wax, more preferably polyethylene wax, be in range of 2 μm or less. When the particle diameter of polyethylene wax is in a range of less than or equal to 2 μm, the precision of the image transferred on a receiving medium is excellent. On the other hand when the particle diameter of polyethylene wax is in a range of more than 2 μm, the precision of the image transferred on a receiving medium is decreased. These waxes may be used alone or in combinations of two or more.

In the another embodiment of the present invention, the separation layer further comprises the metal salt of an ethylene-methacrylic acid copolymer and one or more diols or diol derivatives having an acetylene group, and wherein the ink layer also comprises a metal salt of an ethylene-methacrylic acid copolymer, and one or more diols or diol derivatives having an acetylene group. The amount of copolymer and diol or diol derivative used in the ink layer is the same as noted above. The amount of diol or diol derivative having an acetylene group in the separation layer is preferably in the range of from 0.2 wt % to 2.0 wt %.

As the material for the substrate 120, for instance, conventional films and paper can be employed. More specifically, plastic films with relatively good heat resistance, for example, films of polyester such as polyethylene terephthalate, polycarbonate, triacetyl cellulose, nylon, polyimide; cellophane; and parchment paper are preferable as the substrate material.

In addition, a protection layer may be optionally formed on a backside of the substrate of the thermal transfer recording medium of the present invention. The protection layer is formed to protect the substrate from high temperature when heat is applied thereto by a thermal transfer head. Any desired resin having the requisite heat protection characteristics may be used to form the protection. Suitable examples include, but are not limited to, heat resistant thermoplastic resins, thermosetting resins, ultraviolet curing resins, or electron beam curing resins, with thin films of a fluorocarbon resin, epoxy resin, phenol resin, or melamine resin preferably being used to form the protection layer.

The presence of a protection layer can remarkably improve the heat resistance of the substrate if the protection layer is formed thereon.

The thermal transfer layer comprising the above ink layer and separation layer and protection layer may be any desired thickness, preferably in a range of from 0.1 μm to 10 μm, more preferably in a range of from 0.5 μm to 6.0 μm. The thickness of the ink layer may also be any desired thickness, preferably in a range of from 0.5 μm to 6.0 μm, more preferably from 0.6 μm to 3.0 μm, most preferably from 0.3 μm to 2.0 μm. The thickness of the separation layer may be any desired thickness, preferably in a range of from 0.2 μm to 3.0 μm, more preferably from 0.3 μm to 2.0 μm, most preferably from 0.5 μm to 1.0 μm.

When the thickness of ink layer is less than 0.3 μm, the concentration and solvent resistance of the transferred image is decreased. When the thickness of the ink layer is more than 2.0 μm, the precision of the transferred image is decreased.

When the thickness of the separation layer is less than 0.3 μm, the solvent resistance of the transferred image is decreased. When the thickness of the separation layer is more than 2.0 μm, the precision of the transferred image is decreased.

The thermal transfer recording medium of the present invention can optionally further comprise an under layer between the separation layer and substrate. The thermal transfer recording medium of the present invention can also optionally further comprise an intermediate layer between the separation layer and the ink layer. Additionally, the thermal transfer recording medium of the present invention can optionally further comprise an over layer on the ink layer. These layers are each, where present, independently comprised of one or more of the above mentioned resins, waxes and other optional additives.

The receiving medium used in the thermal transfer recording method of the present invention is not particularly limited. Particularly, the image obtained when a receiving medium according to (1)–(3) below is used has excellent solvent resistance.

(1) A receiving medium comprising a receiving layer on a substrate, wherein the receiving layer comprises an inorganic pigment and a resin.

(2) A receiving medium comprising a receiving layer on a substrate, wherein the receiving layer comprises a metal salt of an ethylene-methacrylic acid copolymer.

(3) A receiving medium comprising a synthetic paper comprised of polypropylene and calcium carbonate having a three layer structure.

Especially preferred receiving media have a receiving layer which comprising an inorganic pigment and a resin on the substrate, and a synthetic paper which comprises polypropylene and calcium carbonate of main component. With these receiving media, the fixation of ink is good and the image formed on the receiving medium is excellent in solvent resistance.

The receiving layer which comprises an inorganic pigment and a resin accepts ink by a function such as oil absorbency of the receiving layer, elasticity and insulation. The receiving layer comprising an inorganic pigment again plays the part to protect an image when a transferred image is scratched with a cloth which contains a solvent so that the surface may have moderate unevenness. It is preferable to use a resin having excellent solvent resistance as the resin of the receiving layer in the present invention. Therefore, it is preferable that the a receiving layer comprise one or more cross-linking agents which are reacted with the resin to crosslink the resin. A resin may be crosslinked by adding a cross-linking agent to react with functional groups contained within the resin, such as, for example, hydroxyl, carboxyl, epoxy and acetoacetyl groups in the resin of the receiving layer.

To obtain a receiving medium according to the preset invention, a variety of conventional resins can be employed in any form, such as neat resin, resin solutions, resin emulsions or resin dispersions. Suitable resins, include, but not limited to:

partially saponified polyvinyl alcohol,
fully saponified polyvinyl alcohol,
carboxyl group modified polyvinyl alcohol,
sodium carboxylates, sodium sulfonates, acetoacetonates, cation group modified
polyvinyl alcohol and polyvinyl alcohol derivatives,
starch and starch derivatives,
cellulose and cellulose derivative, such as
methoxy cellulose,
hydroxyethyl cellulose,
carboxymetyl cellulose,
methyl cellulose,
ethyl cellulose,
polyacrylic acid,
sodium polyacrylate,
polymethacrylic acid,
polyacrylic ester,
polyvinylpyrrolidone,
acrylamide-acrylic acid ester copolymer,
acrylamide-acrylic acid ester-methacrylic acid copolymer,
alkali salt of styrene-maleic anhydride copolymer,
alkali salt of isobutylene-maleic anhydride copolymer,
polyacrylamide,
sodium alginate,
gelatine,
polyvinyl acetate,
polyurethane,
styrene-butadiene copolymer,
acrylonitrile butadiene copolymer,
styrene-butadiene-acrylic copolymer, polyacrylic acid, polyacrylic ester,
polymethacrylic acid ester,
vinyl chloride-vinyl acetate copolymer,
ethylene-vinyl acetate copolymer,
vinyl acetate-acrylic acid copolymer,
ethylene-vinyl acetate acrylic acid copolymer,
urethane modified polyethylene,
styrene-acrylic acid ester copolymer,
ethylene-propylene copolymer,
ethylene vinyl chloride copolymer,
vinyl acetate-ethylene-vinyl chloride copolymer,
metal salt of ethylene-methacrylic acid copolymer,
polyester etc As a cross-linking agent, any conventional cross linking agent for the particular resin used can be employed. Suitable examples include, but are not limited to:
polyamide
epichlorohydrin,
glyoxal,
aziridine,
carbodimide,
oxazoline,
isocyanate,
melamine compound,
epoxy compound, and
multivalent metal salts.

These resin and cross-linking agents be used individually or in combinations of two or more thereof.

In addition, the receiving layer can further comprise an inorganic pigment as filler for the resin. Suitable examples include, but are not limited to, inorganic particulate materials such as calcium carbonate, magnesium carbonate, silica, zinc oxide, titanium oxide, aluminum oxide, zinc hydroxide, barium sulfate, clay, kaolin, calcined kaoline, talc.

The particle diameter of inorganic pigment has preferably range of form 1 μm to 5 μm. When the particle diameter of inorganic pigment is less than 1 μm, the surface of the receiving layer is not rough enough, so the durability of the received image is decreased. When the particle diameter of inorganic pigment is more than 5 μm, the surface of the receiving layer is too rough, so patchy white spots are easy to cause at the time of the ink transfer. Most preferably, the inorganic pigment is calcined kaoline, or silica.

The inorganic pigment is added to the thermal receiving layer in an amount of from 20 wt % to 80 wt % by weight relative to amount of receiving layer. When inorganic pigment is used in an amount less than 20 wt % of the total amount of receiving layer, the receiving ability becomes insufficient. In addition, when the inorganic pigment is used in an amount greater than 80 wt % of the total amount of receiving layer, the strength of the thermal transfer receiving layer is decreased. And when the receiving layer is scraped by a cloth containing solvent, the layer breaks easily.

In the thermal transfer-recording medium of the present invention, when desired, the receiving layer further comprises one or more conventional additives, including but not limited to:
fatty amides such as
stearic acid amide,
palmitate amide,
fatty acid metallic salts such as
zinc stearate,
alminum stearate,
calcium stearate,
zinc palmitate,
zinc behenate
waxes such as
polyethylene wax,
polypropylene wax,
paraffin wax,
carnauba wax,
montan wax,
and surfactant.

The receiving medium of the present invention comprises a receiving layer provided on a substrate, wherein the receiving layer comprises a metal salt of an ethylene-methacrylic acid copolymer and has an excellent ink receiving performance, since the metal salt of ethylene-methacrylic acid copolymer contained in the receiving layer of this receiving medium is chemically similar to an organic ink. Therefore, the ink becomes hard to release from the receiving layer even when the image which transferred is scratched with a cloth that contains a solvent. The metal salt of the ethylene-methacrylic acid copolymer should have a tensile strength (ASTM D 1708) of from 240 kg/cm$^2$ to 300 kg/cm$^2$, more preferably from 250 kg/cm$^2$ to 300 kg/cm$^2$, most preferably 280 kg/cm$^2$ to 300 kg/cm$^2$ and a percentage elongation at break (ASTM D 1708) of from 410% to 560%, more preferably from 440% to 530%, most preferably from 450% to 520% for use in the ink layer, and the metal salt to use for the receiving layer is preferably the crosslinked sodium and/or potassium salt of ethylene-methacrylic acid copolymer. The amount of the salt of ethylene-methacrylic acid copolymer in the receiving layer is preferably in the range of from 80 wt % to 100 wt %. When the amount of the metal salt of ethylene-methacrylic acid copolymer in the ink layer is less than 80 wt %, the transferred image on the receiving medium has decreased resistance. If necessary, other additional resins, such as those noted above can be included in the receiving layer, optionally along with one or more other additives, such as a cross-linking agent, a fatty acid amide, a fatty acid metal salt, a wax and/or a surfactant.

The thickness of the receiving layer on the substrate is preferably in the range of from 2 μm to 20 μm, and has a surface smoothness preferably in the range of from 100 sec to 1000 sec when measured by the method JIS P-8119 (incorporated herein by reference). When the surface smoothness of the receiving layer is less than 100 sec. the image shows white spots on the receiving medium. When the surface smoothness of the receiving layer is more than 1000 sec, when it is processed into a roll-shaped product, blocking occurs in the rear and the surface.

The receiving layer of the receiving medium in one embodiment of the present invention preferably contains a pigment containing a calcium ion and/or a magnesium ion, and a salt of an ethylene-methacrylic acid copolymer. By use of a pigment containing a calcium ion and/or a magnesium ion, and a salt of an ethylene-methacrylic acid copolymer in combination in the receiving layer, the receiving medium exhibits a unique effect, namely the image transferred from the thermal image transfer medium to the receiving medium exhibits excellent solvent resistance, with respect to solvents such as ethanol. Accordingly, a recorded-image bearing receiving medium with a receiving layer containing a pigment containing a calcium ion and/or a magnesium ion, and the salt of an ethylene-methacrylic acid copolymer also exhibits excellent resistance to solvents such as ethanol.

In a salt of an ethylene-methacrylic acid copolymer which is used as a binder resin in the receiving layer, at least part of the carboxylate groups (—COO$^-$) contained in the structural unit of methacrylic acid are ionically bonded to cross-link the molecular chains of the copolymer. As such a salt of an ethylene-methacrylic acid copolymer, for example, Chemipearl S manufactured by Mitsui Chemistry, Inc., can be employed. The amount of the salt of ethylene-methacrylic acid copolymer in the receiving layer is preferably in the range of from 10 wt % to 50 wt %.

The receiving layer containing a pigment that contains calcium ion and/or magnesium ion, and the salt of ethylene-methacrylic acid copolymer can optionally further comprise another resin such as those noted above. A particularly preferred additional resin includes a sodium carboxylate modified polyvinyl alcohol. These optional additional resins can be present in an amount of preferably less than 10 wt % on the total amount of receiving layer.

Preferably, the salt of an ethylene-methacrylic acid copolymer contained in the receiving layer is cross-linked, more preferably through an epoxy compound. By cross-linking the molecular chains of the salt of an ethylene-methacrylic acid copolymer contained in the receiving layer, preferably by an epoxy compound, the solvent resistance of the image transferred to the receiving layer (in particular, the resistance against an aromatic organic solvent) and the strength of the receiving layer can be improved.

Specifically, the epoxy compound reacts with a carboxyl group (—COOH) which is partially contained in the molecule of the salt of an ethylene-methacrylic acid copolymer to cross-link the molecular chains of the salt of an ethylene-methacrylic acid copolymer. As the epoxy compound for cross-linking the salt of an ethylene-methacrylic acid copolymer, epoxy compounds of a polyhydroxy alkane polyglycidyl ether type, with an epoxy equivalent of from 140 mg/eq to 350 mg/eq, are preferable. It is preferable that the amount of the above epoxy compound to be added to the receiving layer be in the range of from 0.3 wt % to 2.5 wt %.

The receiving layer comprises a pigment which containing a calcium ion and/or a magnesium ion. Suitable examples of such pigments include, but are not limited to:
calcium carbonate,
calcium silicate,
magnesium hydrate,
and magnesium carbonate, etc.

Most preferably the receiving layer comprises pigment, which is calcium carbonate. Further the receiving layer can optionally include an inorganic pigment other than those containing calcium and/or magnesium, including but not limited to:
silica,
zinc dioxide,
titanium oxide,
aluminum hydroxide,
zinc hydroxide,
barium sulfide,
clay,
kaolin,
calcined kaoline,
talc, etc.

Additionally, the receiving layer can optionally include an organic pigment, including, but not limited to:
urea-formaldehyde resin,
styrene-acrylic acid copolymer
polystyrene, etc.

However, it is desirable that the pigment which contains calcium ion and/or magnesium ion is 50 wt % and more, based on the entire amount of pigment present. It is preferable that the amount of the pigment which includes calcium ion and/or magnesium ion be in a range of from 50 wt % to 90 wt %, more preferably in a range of from 60 wt % to 75 wt %, of the entire weight of the receiving layer. When the amount of the pigment in the receiving layer is less than 50 wt %, the solvent resistance of the transferred image on the receiving medium is decreased. When the amount of the pigment in the receiving layer is more than 90 wt %, the strength of the receiving medium is decreased.

The pigment preferably has a particle diameter in a range of from 4.0 μm to 2.5 μm. When the particle diameter of the pigment in the receiving layer is less than 2.5 μm, the solvent resistance of the transferred image on the receiving medium is decreased. When the particle diameter of the pigment in the receiving layer is more than 4.0 μm, the precision of the image transferred on a receiving medium is decreased.

The receiving layer may optionally contain other additives, such as lubricants (such as paraffin wax or one of the other waxes noted above), dispersants, and surfactants (such as metal salts of higher fatty acids).

The receiving layer preferably has an area density in the range of from 4 $g/m^2$ to 8 $g/m^2$. When the areal density of receiving layer is less than 4 $g/m^2$, the precision of the transferred image on the receiving medium is decreased. When the area density of the receiving layer is more than 8 $g/m^2$, the solvent resistance of the transferred image on the receiving medium is decreased.

In addition, after a receiving layer is formed on the substrate, it is preferred to provide the desired smoothness on the surface of the receiving layer (JIS P-8119) by processing the receiving layer with a supercalendar or similar device for a time period of more than 500 sec to less than 1500 sec. When a smoothness on the surface of the receiving layer is under 500 sec, the surface of the receiving layer decreases the minuteness of the image which was too coarse and which was transferred. The surface of the receiving layer is too smooth when a smoothness on the surface of the receiving layer exceeds 1500 sec. When friction occurs in the receiving medium due to insufficient smoothness (improper smoothness), the ink layer also suffers friction. This results in decreased solvent resistance of the transferred image on the receiving layer.

As substrate of the receiving medium, any conventional substrate material can be used, including but not limited to:
plastic films such as;
polyethylene terephthalate,
polyethylene,
polypropylene,
polyvinyl chloride,
polyether sulfone,
polyphenylene sulfide,
polyetherimide,
polyether ketone,
polyimide,
nylon,
vinylon,
polyolefine synthetic paper,
paper, and
nonwoven fabric.

A polypropylene and a polyester film are preferred in terms of strength, solvent resistance and cost.

Suitable specific films include, but are not limited to, for example,
YUPO: manufactured by YUPO corp.
CARRE: manufactured by Chisso Corp.,
TOYOPEARL: manufactured by Toyobo. Co., Ltd.
LUMIRRO: manufactured by Toray corp.
CRISPER: manufactured by Toyobo. Co., Ltd.
TEFLON: manufactured by DUPONT Ltd.

The thermal receiving medium of the present invention may further comprise an under layer between the substrate and the receiving layer. In such cases, the under layer comprises as the main component plastic minute void particles or a porous structure. Moreover, the under layer comprises as the main component a resin, thereby improving adhesive property between the substrate and receiving layer.

In the recording method of the present invention, when a receiving medium is used comprising a multi-layered porous synthetic paper, which is preferably prepared by a biaxial orientation film method from a mixture of polypropylene and calcium carbonate, and fabricated, using a substrate layer serving as a base, and a paper-like layer layered on each of both sides of the base layer, images obtained on the receiving medium exhibit excellent solvent resistance.

Suitable examples of preferred papers include a synthetic paper manufactured by the YUPO CORP. and a synthetic paper manufactured by CHISSO CORP., each comprising polypropylene and calcium carbonate as main components.

In the present invention, the receiving medium has a receiving layer on the substrate, with a product layer on the surface of the opposite side, wherein the product layer has an adhesive layer and releasing paper one after another. The receiving medium can be processed into the form of a label.

In the present invention, it is preferable that the overall thickness of the substrate, the receiving layer, and the pressure-sensitive adhesive layer which is provided when necessary, be in the range of from 40 μm to 250 μm. When the overall thickness is less than 40 μm, the strength of the receiving medium is lowered to the point that it can be easily torn, while when the overall thickness is more than 250 μm and such a receiving medium is attached as a label to a receiving sheet or material, it can be caught and easily detached therefrom.

In another preferred embodiment of the present invention, the receiving medium further has an adhesive layer. The adhesive layer is provided on the backside of the substrate, on the side opposite to the receiving layer with respect to the substrate. When an image is transferred by a receiving medium which has an adhesive layer from thermal transfer recording medium, a label-shaped recorded medium can be produced that can stick to a desired location due to the adhesion of the adhesive layer. The adhesive layer of the receiving medium comprises a pressure-sensitive adhesive or a heat-sensitive adhesive. Specific examples of pressure-sensitive adhesive include, but are not limited to:

natural rubber,
styrene-butadiene copolymer,
butyl rubber,
poly isobutylene,
polyacrylate,
vinyl ether polymer, and
silicon.

A heat-sensitive adhesive comprises a thermoplastic resin, a tackifier and a heat melting material as main components. Heat melting material melts when it is heated, and is a solid at room temperature. Specific examples of heat-sensitive adhesive include, but are not limited to:

natural rubber,
polyvinyl acetate,
vinylacetate-acrylate-2-ethlyhexyl copolymer,
vinylacetate-ethylene copolymer,
vinylpyrrolidone-styrene copolymer,
vinylpyrrolidone-acrylate ester copolymer,
styrene-butadiene-butadiene copolymer,
acryl-butadiene copolymer, and
styrene-acrylate copolymer.

A receiving medium having this adhesive layer can have the strippable paper carrier which adjoins the adhesive layer. A receiving medium which has an adhesive layer and a strippable paper carrier lets the receiving medium stick to a desired location by removing the strippable paper carrier, thereby exposing the adhesive layer.

The recorded medium (for example, label) of the present invention as described above having an image transferred to a receiving medium, having an adhesive layer and a strippable paper carrier can take various forms and is available with various fields and uses. The recorded medium in accordance with the present invention has solvent resistance, and the deterioration of the image and elimination are decreased in the environment as well where a recorded medium touches solvent or solvent vapors.

The recorded label of the present invention having an adhesive layer and a strippable paper carrier can be used for the various uses, including, but not limited to, a control of a part such as an inscription board in the manufacturing industry, a lot number identifier, a caution label, contents indicator such as for chemicals and other materials and specimen control in a medical institution

EXAMPLES

Having generally described this invention, further understanding can be obtained by reference to certain specific examples that are provided herein for the purpose of illustrating only and are not intended to be limiting. In the descriptions in the following examples, the number represents weight ratios in parts, otherwise specified.

The following printing condition makes use of a sample item of an execution example and a comparative example, showing an evaluation method of solvent resistance for the recorded medium.

(Printing Condition)

Printer: 140Xi manufactured by Zebra Co. Ltd.,

Printing speed: 3 inch/sec (Solvent Resistance Test)

0.5 cc of toluene was painted on the transferred images and a rubbing test reciprocating for 75 times was performed thereon under 100 g/cm$^2$ load.

The printed surface of the receiving material was observed and the printed images were evaluated by the following standards.

5 The sample before and after the test showed no change.

4 The sample after the test showed some loss of image, but decipherment is possible, with minor scarring.

3 The sample after the test showed some loss of image, but decipherment is possible, with scarring.

2 The sample after the test showed loss of image to the point that decipherment is impossible.

1 The sample after the test showed elimination of the images.

Example 1

(1) Preparation of Thermal Transfer Recording Medium

A substrate was prepared of polyethylene terephthalate film of 4.5 μm thickness.

Then, silicone rubber (SD7226 manufactured by Dow Corning Toray Silicone Co. Ltd.) was applied to the opposite side at the side having the thermal transfer record layer.

The coating weight was 0.35 g/m$^2$ after drying. The resulting substrate having heat resistance and lubricity was then dried.

[Formation of Separation Layer]

A mixture of the following components was dispersed in toluene, whereby a coating liquid for the formation of a separation layer was prepared.

| | |
|---|---|
| 10% toluene dispersion of carnauba wax: | 90 parts |
| 10% toluene dispersion of ethylene-vinyl acetate copolymer: (Vinyl acetate contain: 28 wt % MFR: 15 dg/min) | 10 parts |

The thus prepared coating liquid for the formation of a separation layer was coated on the substrate and dried, whereby a separation layer with a thickness of 1.0 μm was formed on the substrate.

[Formation of Ink Layer]

| | |
|---|---|
| Metallic salt of ethylene-methacrylic acid copolymer: (Chemipearl S-650: manufactured by Mitsui Chemistry, Inc., Tensile strength: 280 kg/cm$^2$, Percentage elongation at break: 450%, sodium salt) (Solid content: 27%) | 62 parts |
| 10% aqueous dispersion of carbon black: (Solid content: 38%) | 22 parts |
| Water: | 16 parts |

The thus prepared coating liquid for the formation of an ink layer was coated on the above formed separation layer and dried, whereby an ink layer with a thickness of 1.0 μm was formed on the separation layer.

Thus, a thermal transfer recording medium was prepared.

(1) Preparation of Receiving Medium

[Formation of Receiving Layer]

| | |
|---|---|
| Aqueous dispersion of calcined kaoline: (Oil absorption 105 ml/100 g, solid content 25%) | 20 parts |
| Solution of carboxyl modified Polyvinyl alcohol: (Solid content 10%) | 25 parts |
| polyamide epichlorohydrin polymer: (Solid content 12.5%) | 20 parts |
| water: | 35 parts |

The thus prepared coating liquid for the formation of a receiving layer was coated on a polyester synthetic paper with a thickness of 50 μm (manufactured by Toyobo Corporation) above formed separation layer and dried, whereby a receiving layer with a thickness of 5.0 μm was formed on the substrate.

Thus, a receiving medium was prepared.

The receiving medium has 3000 sec of surface smoothness.

The thermal transfer recording medium and receiving medium thus obtained were tested their evaluation tests to obtain the result shown in Table 1.

Example 2

The procedure for preparation of thermal transfer recording medium of Example 1 was repeated except that the formulation of the ink layer was changed to be the following formulation.

A receiving medium was evaluated according to the procedure of Example 1.

[Formation of Ink Layer]

| | |
|---|---|
| Metallic salt of ethylene-methacrylic acid copolymer: (Chemipearl S-659: manufactured by Mitsui Chemicals, Inc., Tensile strength: 280 kg/cm$^2$, Percentage elongation at break: 450%, potassium salt) (Solid content: 25%) | 62 parts |
| Aqueous dispersion of carbon black: (Solid content: 38%) | 22 parts |
| Water: | 16 parts |

Example 3

The procedure for preparation of thermal transfer recording medium of Example 1 was repeated except that the formulation of the separation layer was changed to be the following formulation.

The thus formed receiving medium was evaluated in accordance with the procedure used in Example 1.

[Formation of separation Layer]

| | |
|---|---|
| toluene dispersion of polyethylene wax: (melting point: 126° C. DSC method) (Solid content: 10%) | 90 parts |
| 10% toluene dispersion of ethylene-vinyl acetate copolymer: (Vinyl acetate contain: 28 wt %, MFR: 15 dg/min): | 10 parts |

Example 4

The procedure for preparation of thermal transfer recording medium of Example 1 was repeated except that the receiving medium was change to be the B-412 (manufactured by Brady Company).

The B-412 comprises a receiving layer, which included kaoline and resin on a substrate of polypropylene.

The thermal transfer recording medium and the receiving medium were evaluated in accordance with the procedures used in Example 1.

Example 5

The procedure for preparation of thermal transfer recording medium of Example 1 was repeated except that the receiving medium was change to be the following. The thermal transfer recording medium and the receiving medium were evaluated in accordance with the procedures used in Example 1.

[Formation of Ink Layer]

| | |
|---|---|
| Metallic salt of ethylene-methacrylic acid copolymer: (Chemipearl S-650: manufactured by Mitsui Chemicals, Inc. Tensile strength: 280 kg/cm$^2$, Percentage elongation at break: 450%, sodium salt) (Solid content: 27%) | 100 parts |

The thus prepared coating liquid for the formation a receiving layer was coated on a polyester synthetic paper with thickness 50 μm (manufactured by Toyobo corporation) above formed separation layer and dried, whereby a receiving layer with a thickness of 5.0 μm was formed on the substrate.

Thus, a receiving medium was prepared.

The surface of the receiving layer had a smoothness of 3500 sec.

Example 6

The procedure for preparation of thermal transfer recording medium of example 1 was repeated except that the receiving medium was change to be a synthetic paper of multilayer structure (SGS: manufactured by YUPO corp.). The thermal transfer recording medium and the receiving medium were evaluated in accordance with the procedures used in Example 1.

Comparative Example 1

The procedure for preparation of thermal transfer recording medium of Example 1 was repeated except that the formulation of the ink layer was changed to be the following formulation. The formed receiving medium was evaluated in accordance with the procedures used in Example 1.

[Formation of Ink Layer]

| | |
|---|---|
| Metallic salt of ethylene-methacrylic acid copolymer: (Chemipearl S-100: manufactured by Mitsui Chemicals, Inc., Tensile strength: 350 kg/cm$^2$, Percentage elongation at break: 350%, sodium salt) (Solid content: 27%) | 62 parts |
| Aqueous dispersion of carbon black: (Solid content: 38%) | 22 parts |
| Water: | 16 parts |

Comparative Example 1

The procedure for preparation of thermal transfer recording medium of Example 1 was repeated except that the formulation of the ink layer was changed to be the following formulation. The formed receiving medium was evaluated in accordance with the procedures used in Example 1.

[Formation of Ink Layer]

| | |
|---|---|
| Metallic salt of ethylene-methacrylic acid copolymer: (Chemipearl S-200: manufactured by Mitsui Chemicals, Inc.., Tensile strength: 320 kg/cm$^2$, Percentage elongation at break: 400%, sodium salt) (Solid content: 27%) | 62 parts |
| Aqueous dispersion of carbon black: (Solid content: 38%) | 22 parts |
| Water: | 16 parts |

Comparative Example 3

The procedure for preparation of thermal transfer recording medium of Example 1 was repeated except that the formulation of the ink layer was changed to be the following formulation. The formed receiving medium was evaluated in accordance with the procedures used in Example 1.

[Formation of Ink Layer]

| | |
|---|---|
| Metallic salt of ethylene-methacrylic acid copolymer: (Chemipearl SA-100: manufactured by Mitsui Chemicals Inc., Tensile strength: 330 kg/cm$^2$, Percentage elongation at break: 350%, sodium and potassium salts) (Solid content: 25%) | 62 parts |
| Aqueous dispersion of carbon black: (Solid content: 38%) | 22 parts |
| Water: | 16 parts |

Comparative Example 4

The procedure for preparation of thermal transfer recording medium of Example 1 was repeated except that the formulation of the ink layer was changed to be the following formulation. The formed receiving medium was evaluated in accordance with the procedures used in Example 1.

[Formation of Ink Layer]

| | |
|---|---|
| Methyl ethyl ketone solution of polyester: (UE3200: manufactured by Unitika Ltd.) (Solid content: 20%) | 67 parts |
| Methyl ethyl ketone dispersion of carbon black: (Solid content: 20%) | 33 parts |

The results are shown in Table 1.

TABLE 1

| | Result of acetone resistance | Result of toluene resistance |
|---|---|---|
| EX. 1 | 5 | 4 |
| EX. 2 | 5 | 4 |
| EX. 3 | 5 | 5 |
| EX. 4 | 5 | 4 |
| EX. 5 | 5 | 4 |
| EX. 6 | 5 | 4 |
| Co-EX. 1 | 2 | 1 |
| Co-EX. 2 | 2 | 1 |
| Co-EX. 3 | 2 | 1 |
| Co-EX. 4 | 2 | 1 |

The results of Table 1 show that the thermal transfer recording medium, receiving medium and recording method of the present invention provide an image which has an excellent solvent resistance against solvents such as toluene and acetone.

Example 7

(1) Preparation of Thermal Transfer Recording Medium

A polyethylene terephthalate film of the 4.5 μm thickness was used as a substrate. A heat lubricity resistance layer was formed from silicone rubber (SD7226: manufactured by Dow Corning Toray Silicone Co. Ltd.) on the substrate in an amount of 35 g/m$^2$ on a side opposite to the side of the substrate containing the heat transfer recording layer.

[Formation of Separation Layer]

| | |
|---|---|
| Aqueous dispersion of polyethylene wax: (Softing point 132° C., particle diameter 0.6 μm) (Solid content: 40%) | 45 parts |
| Ethylene-vinyl acetate copolymer: (EV-200H: manufactured by Mitsui Chemicals, Inc.) (Solid content: 40%) | 5 parts |
| Water: | 50 parts |

A separation layer liquid having the above formation was coated on the thermal transfer recording layer side of the substrate and dried so as to have a thickness of about 1.0 μm to form a separation layer.

[Formation of Ink Layer]

| | |
|---|---|
| Aqueous dispersion of metallic salt of ethylene-methacrylic acid copolymer: (Solid content: 27%) | 52 parts |
| Aqueous dispersion of carbon black: (Solid content: 38%) | 22 parts |
| 2,4,7,9-tetramethyl-5-decyn-4,7-diol: 0.05 parts | |
| Water: | 32 parts |

The thus prepared coating liquid for the formation a ink layer was coated on the above formed separation layer and dried, whereby a ink layer with a thickness of 0.8 μm was formed on the separation layer.

Thus, a thermal transfer recording medium was prepared.

(2) Preparation of Receiving Medium

[Formation of Receiving Layer]

| | |
|---|---|
| Aqueous dispersion of calcined kaoline: (Oil absorption: 105 ml/100 g) (Solid content: 25%) | 20 parts |
| Aqueous solution of carboxyl modified Polyvinyl alcohol: (Solid content: 10%) | 25 parts |
| poly amide epichlorohydrin polymer: (Solid content: 12.5%) | 20 parts |
| Water: | 35 parts |

The thus prepared coating liquid for the formation of a receiving layer was coated on a polyester synthetic paper having thickness 50 μm (manufactured by Toyobo Co., Ltd.) formed on the substrate and dried, whereby a receiving layer with a thickness of 5.0 μm was formed on the substrate. Thus, a receiving medium was prepared. The surface of the receiving layer had a smoothness of 3000 sec.

An evaluation test by the following method was performed on the thermal transfer recording medium and the receiving medium. It was printed by the following condition, and evaluated.

(Printing Condition)
Printer: 140Xi manufactured by Zebra Co. Ltd.,
Printing speed: 3 inch/sec Various evaluated characters are shown in the following.

(Solvent Resistance)

0.5 cc of toluene was painted on the transferred images and a rubbing test reciprocating for 75 times was performed thereon under 100 g/cm$^2$ load.

The printed surface of the receiving material was observed and the printed images were evaluated by following standards.

5 The sample before and after the test showed no change.
4 The sample after the test showed decipherment of the image, but only minor scarring.
3 The sample after the test showed decipherment of the image, with scarring.
2 The sample after the test showed image, but decipherment was impossible.
1 The sample after the test showed elimination of the image.

Example 8

The procedure for preparation of thermal transfer recording medium of Example 7 was repeated except that the formulation of the ink layer was changed to be the following formulation. The formed receiving medium was evaluated in accordance with the procedures used in Example 7.

[Formation of Separation Layer]

| | |
|---|---|
| Aqueous dispersion of polyethylene wax: (Softing point 132° C., particle diameter 0.6 μm) (Solid content: 40%) | 45 parts |
| Ethylene-vinyl acetate copolymer: (EV-200H: manufactured by Mitsui Chemicals, Inc., solid content 40%) | 5 parts |
| 2,4,7,9-tetramethyl-5-decyn-4,7-diol: 0.05 parts | |
| Water: | 50 parts |

A separation layer liquid having the above formation was coated on thermal transfer recording layer side of the substrate and dried so as to have a thickness of about 1.0 μm to form a separation layer.

Example 9

The procedure for preparation of thermal transfer recording medium of example 7 was repeated except that the receiving medium was change to be the synthetic paper of multilayer structure (SGS: manufactured by YUPO corp.). The formed thermal transfer recording medium and receiving medium were evaluated in accordance with the procedures used in Example 7.

Comparative Example 5

The procedure for preparation of thermal transfer recording medium of Example 7 was repeated except that the formulation of the ink layer was changed to be the following formulation. The formed receiving medium was evaluated in accordance with the procedures used in Example 7.

[Formation of Ink Layer]

| | |
|---|---|
| Metallic salt of ethylene-methacrylic acid copolymer: (Solid content: 27%) | 52 parts |
| Aqueous dispersion of carbon black: (Solid content: 38%) | 16 parts |
| Water: | 32 parts |

Comparative Example 6

The procedure for preparation of thermal transfer recording medium of Example 7 was repeated except that the formulation of the ink layer was changed to be the following formulation. The formed receiving medium was evaluated in accordance with the procedures used in Example 7.

[Formation of Ink Layer]

| | |
|---|---|
| Metallic salt of ethylene-methacrylic acid copolymer: (Solid content: 27%) | 52 parts |
| Aqueous dispersion of carbon black: (Solid content: 38%) | 16 parts |
| Polyoxyethylene sorbitan mono stearate: 0.05 parts | |
| Water: | 32 parts |

Comparative Example 7

The procedure for preparation of thermal transfer recording medium of Example 7 was repeated except that the formulation of the ink layer was changed to be the following formulation. The formed receiving medium was evaluated in accordance with the procedures used in Example 7.

[Formation of Ink Layer]

| | |
|---|---|
| Aqueous dispersion of polyester: (Vylonal MD-1245 manufactured by Toyobo Co., Ltd.) (Solid content: 30%) | 47 parts |
| Aqueous dispersion of carbon black: (Solid content: 38%) | 16 parts |
| 2,4,7,9-tetramethyl-5-decyn-4,7-diol: 0.05 parts | |
| Water: | 38 parts |

The results are shown in Table 2.

The results of Table 2 show that the image had an excellent solvent resistance for toluene in the present invention.

TABLE 2

| | Result of toluene resistance |
|---|---|
| EX. 7 | 4 |
| EX. 8 | 5 |
| EX. 9 | 4 |
| Co-EX. 5 | 3 |
| Co-EX. 6 | 1 |
| Co-EX. 7 | 1 |

This document claims priority and contains subjected matter related to Japan Patent Applications No. 2003-39790 and 2003-421515, filed on Feb. 18, 2003, and Dec. 18, 2003, respectively, the entire contents of each of which are incorporated herein by reference

The invention claimed is:

1. A thermal transfer recording medium comprising:

a substrate;

a separation layer on said substrate, wherein the separation layer comprises a resin and a wax; and an ink layer on said separation layer, wherein the ink layer comprises a colorant and a metal salt of an ethylene-methacrylic acid copolymer, said metal salt comprising at least one metal salt component selected from the group consisting of a sodium salt of ethylene-methacrylic acid copolymer and a potassium salt of ethylene-methacrylic acid copolymer, and having a tensile strength (ASTM D 1708) of from 240 kg/cm$^2$ to 300 kg/cm$^2$ and having a percentage elongation at break (ASTM D 1708) of from 410% to 560%.

2. The thermal transfer recording medium as claimed in claim 1, wherein said wax comprises a polyethylene wax having a melting point (DSC method) of 120° C. or above.

3. The thermal transfer recording medium as claimed in claim 2, wherein said polyethylene wax has particle diameter of 2 μm or less.

4. The thermal transfer recording medium as claimed in claim 1, wherein said resin in the separation layer comprises a methyl methacrylate-butadiene copolymer.

5. The thermal transfer recording medium as claimed in claim 4, wherein said methyl methacrylate-butadiene copolymer has glass transition temperature of 0° C. or less.

6. A thermal image transfer recording method comprising the steps of:

bringing said thermal transfer recording medium as defined in claim 1 into contact with a receiving medium, said receiving medium comprising a substrate and a receiving layer thereon, wherein the receiving layer comprises an inorganic pigment and a resin, and applying heat to said thermal transfer recording medium which is in contact with said receiving medium to transfer said ink layer of said thermal transfer recording medium to said receiving medium and form an image thereon.

7. The thermal transfer recording method as claimed in claim 6, wherein said inorganic pigment comprises a calcium ion and/or a magnesium ion, and said resin in said receiving layer comprises a metal salt of ethylene-methacrylic acid copolymer.

8. The thermal transfer recording method as claimed in claim 6, wherein said salt of ethylene-methacrylic acid copolymer is cross-linked using a epoxy compound as a cross-linking agent.

9. The thermal transfer recording method as claimed in claim 6, wherein said inorganic pigment in the receiving layer has particle diameter of from 2.5 μm to 4.0 μm.

10. The thermal transfer recording method as claimed in claim 6, wherein said inorganic pigment is included in the receiving layer in an amount of from 50% to 90% by weight based on total weight thereof.

11. The thermal transfer recording method as claimed in claim 6, wherein said receiving layer further comprises a sodium salt of carboxylate modified polyvinyl alcohol.

12. The thermal transfer recording method as claimed in claim 6, wherein said receiving layer comprises a metal salt of ethylene-methacrylic acid copolymer, on said substrate.

13. The thermal transfer recording method as claimed in claim 6, wherein said metal salt of an ethylene-methacrylic acid copolymer, comprises at least one metal salt component selected from the group consisting of a sodium salt of ethylene-methacrylic acid copolymer and a potassium salt of ethylene-methacrylic acid copolymer, and having a tensile strength (ASTM D 1708) of from 240 kg/cm$^2$ to 300 kg/cm$^2$ and having a percentage elongation at break (ASTM D 1708) of from 410% to 560%.

14. The thermal transfer recording method as claimed in claim 6, wherein the surface of said receiving layer has a smoothness of from 500 sec to 1500 sec when measured by the method JIS P-8119.

15. The thermal transfer recording method as claimed in claim 6, wherein said receiving layer has a area density of from 4 g/m$^2$ to 8 g/m$^2$.

16. The thermal transfer recording method as claimed in claim 6, further comprising an under layer located between said substrate and said thermal transfer receiving layer.

17. The thermal transfer recording method as claimed in claim 6, wherein said thermal receiving medium comprises a lamination layer of synthetic paper, which comprising polypropylene and calcium carbonate.

18. The thermal transfer recording method as claimed in claim 6, further comprising an adhesive layer provided on a backside of said substrate, opposite to said thermal transfer receiving layer with respect to said substrate.

19. The thermal transfer recording method as claimed in claim 18, further comprising a releasable backing sheet provided on said adhesive layer.

20. A recorded medium prepared by the method of claim 6.

21. The recorded medium of claim 20, wherein said recorded medium is a recorded label.

22. A thermal transfer recording medium comprising:

a substrate; and an ink layer on said substrate; wherein said ink layer comprises:

a colorant, a metal salt of an ethylene-methacrylic acid copolymer, and one or more diols and/or diol derivatives having an acetylene group.

23. The thermal transfer recording medium as claimed in claim 22, further comprising a separation layer between said substrate and said ink layer, wherein said separation layer comprises a resin and a wax.

24. The thermal transfer recording medium as claimed in claim 23, wherein said separation layer further comprises one or more diols and/or diol derivatives having an acetylene bond.

25. The thermal transfer recording medium as claimed in claim 23, wherein said ink layer has a thickness of from 0.6 μm to 1.0 μm; and said separation layer has a thickness of from 0.8 μm to 1.2 μm.

26. The thermal transfer recording medium as claimed in claim 23, wherein said resin comprises a methyl methacrylate-butadiene copolymer.

27. The thermal transfer recording medium as claimed in claim 26, wherein said methyl methacrylate-butadiene copolymer has glass transition temperature of 0° C. or less.

28. The thermal transfer recording medium as claimed in claim 23, wherein said wax comprises a polyethylene wax.

29. The thermal transfer recording medium as claimed in claim 28, wherein said wax has a melting point (DSC method) of 120° C. or above.

30. The thermal transfer recording medium as claimed in claim 28, wherein said wax has a particle diameter of 2 μm or less.

31. A thermal transfer recording method comprising the step of:

contacting a thermal transfer recording medium as claimed in claim 22 and a receiving medium which comprises a substrate and a receiving layer thereon, wherein the receiving layer comprises a resin and an inorganic pigment; and heating an ink layer of the thermal transfer recording medium with a thermal head while the ink layer contacts the receiving layer to form a recorded layer on the substrate.

32. The thermal transfer recording method as claimed in claim 31, wherein said inorganic pigment comprises a calcium ion and/or a magnesium ion, and said resin in the receiving layer comprises a salt of ethylene-methacrylic acid copolymer.

33. The thermal transfer recording method as claimed in claim 32, wherein said salt of ethylene-methacrylic acid copolymer is crosslinked using a epoxy compound as a crosslinking agent.

34. The thermal transfer recording method as claimed in claim 31, wherein said inorganic pigment in said receiving layer has particle diameter of from 2.5 μm to 4.0 μm.

35. The thermal transfer recording method as claimed in claim 31, wherein the inorganic pigment is included in said receiving layer in an amount of from 50% to 90% by weight based on total weight thereof.

36. The thermal transfer recording method as claimed in claim 31, wherein the receiving layer further comprises a sodium salt of carboxylate modified polyvinyl alcohol.

37. The thermal transfer recording method as claimed in claim 31, wherein the surface of said receiving layer has a smoothness of from 500 sec to 1500 sec when measured by the method JIS P-8119.

38. The thermal transfer recording method as claimed in claim 31, wherein said receiving layer has an area density of from 4 $g/m^2$ to 8 $g/m^2$.

39. The thermal transfer recording method as claimed in claim 22, wherein said receiving medium comprises a synthetic paper, which comprises polypropylene and calcium carbonate.

40. The thermal transfer recording method as claimed in claim 31, further comprising an adhesive layer provided on a backside of said substrate, opposite to said receiving layer with respect to said substrate.

41. The thermal transfer recording method as claimed in claim 40, further comprising a releasable backing sheet provided on said adhesive layer.

42. A recorded medium prepared by the method of claim 31.

43. The recorded medium of claim 42, wherein said recorded medium is a recorded label.

* * * * *